US011324988B1

(12) United States Patent
Reed

(10) Patent No.: US 11,324,988 B1
(45) Date of Patent: May 10, 2022

(54) WEIGHT MODIFICATION CLAMP AND METHOD

(71) Applicant: Micro Gainz LLC, Clearfield, PA (US)

(72) Inventor: Michael Reed, Clearfield, PA (US)

(73) Assignee: Micro Gainz, LLC, Clearfield, PA (US)

( * ) Notice: Subject to any disclaimer, the term of this patent is extended or adjusted under 35 U.S.C. 154(b) by 0 days.

(21) Appl. No.: 17/095,692

(22) Filed: Nov. 11, 2020

(51) Int. Cl.
*A63B 21/072* (2006.01)

(52) U.S. Cl.
CPC ..... *A63B 21/0728* (2013.01)

(58) Field of Classification Search
CPC ..... A63B 21/0728; A63B 21/00058; A63B 21/00061; A63B 21/00065; A63B 21/0601; A63B 21/0615; A63B 21/072–0783; A63B 2244/09
See application file for complete search history.

(56) References Cited

U.S. PATENT DOCUMENTS 1,779,594 A * 10/1930 David ..... A63B 21/0728 482/107
3,521,883 A * 7/1970 Hamilton ..... A63B 59/50 473/437
4,743,017 A 5/1988 Jaeger
4,913,422 A 4/1990 Elmore et al.
4,971,318 A * 11/1990 Tracy ..... A63B 21/0728 482/107
4,986,417 A * 1/1991 Hsu ..... B43M 99/009 206/214
5,062,631 A * 11/1991 Dau ..... A63B 21/0728 482/107
5,344,375 A * 9/1994 Cooper ..... A63B 21/0728 482/106
5,415,607 A * 5/1995 Carpenter ..... A63B 21/0728 482/106
5,749,814 A * 5/1998 Chen ..... A63B 21/0004 473/437
6,083,144 A 7/2000 Towley et al.
6,682,464 B2 * 1/2004 Shifferaw ..... A63B 21/0728 482/104

(Continued)

OTHER PUBLICATIONS

Amazon.com, "Micro Gainz 1.25LB Dumbbell Fractional Weight Plates 2 or 4 Pack (Choose a Set)—Designed for Dumbbell Training and Micro Loading, Made in USA", Feb. 20, 2019, 13 pages, retrieved from the Internet: https://www.amazon.com/Dumbbell-Fractional-Designed-Training-Loading/dp/B08136QNGX (Year: 2019).*

*Primary Examiner* — Garrett K Atkinson
*Assistant Examiner* — Kathleen M Fisk
(74) *Attorney, Agent, or Firm* — William C. Schrot; Jeffrey I. Auerbach; AuerbachSchrot LLC

(57) ABSTRACT

A weight modification clamp includes first and second hingedly connected plates configured to be coupled to a bar of a weight-lifting device, such as a dumbbell, barbell or a kettlebell. First end portions of the first and second plates are pivotably connected and movable about a rotational axis so that opposing second end portions of the first and second plates are movable between a closed orientation and an open orientation and along a plane substantially perpendicular to the rotational axis. The first and second plates define a central opening configured to receive and retain the bar therein.

16 Claims, 7 Drawing Sheets

(56) References Cited

U.S. PATENT DOCUMENTS

| | | | | |
|---|---|---|---|---|
| 7,494,451 | B1 * | 2/2009 | Ramos | A63B 21/0728 482/107 |
| 7,794,373 | B2 | 9/2010 | Crawford et al. | |
| 9,452,313 | B2 * | 9/2016 | Thomas | A63B 21/078 |
| 10,252,098 | B2 | 4/2019 | Wilke | |
| 10,328,299 | B2 * | 6/2019 | Wang | A63B 21/075 |
| 2002/0107118 | A1 * | 8/2002 | Shifferaw | A63B 21/0728 482/106 |
| 2004/0259696 | A1 * | 12/2004 | Shifferaw | A63B 21/4047 482/94 |
| 2005/0075221 | A1 * | 4/2005 | Fond | A63B 21/0728 482/93 |
| 2011/0162173 | A1 * | 7/2011 | Ciminski | A63B 21/0728 24/303 |
| 2018/0147439 | A1 * | 5/2018 | Woods | A63B 21/0728 |
| 2019/0015723 | A1 * | 1/2019 | Trygg | A63B 59/20 |
| 2020/0015517 | A1 * | 1/2020 | Spektor | A24F 13/08 |
| 2021/0339072 | A1 * | 11/2021 | Benoit | A63B 21/0604 |

* cited by examiner

WEIGHT MODIFICATION CLAMP AND METHOD

FIELD OF THE INVENTION

The present invention relates to a weight modification clamp having a pair of pivotally connected plates that define an opening for receiving and tensionably retaining therein a bar of a weightlifting device such as a dumbbell, a barbell, or a kettlebell.

BACKGROUND OF THE INVENTION

Numerous designs for fitness and strength training equipment have been developed, e.g., including fixed weight and adjustable weight devices such as barbells, dumbbells, kettlebells, etc. Fixed weight devices generally include a bar configured for gripping with one or both hands, and opposing ends having a predetermined amount of weight thereon, such that the entire device has a specific weight. Fixed weight dumbbells are particularly common and suitable for numerous different types of exercises. However, the various exercises generally require dumbbells having different weights. As such, individuals will generally need multiple fixed weight dumbbells, and preferably a pair of dumbbells in each weight, for the various exercises. Adjustable weight devices such as barbells and dumbbells also include a bar for gripping with one or both hands, and loading sleeves on opposing ends thereof on which weights (e.g., weight plates) may be secured. The overall weight of the barbell or dumbbell may be changed by adding or removing plates from opposing ends of the bar, as well known in the industry.

Most fixed weight dumbbells, or plates for adjustable weight bars, are available in five-pound weight increments (e.g., 5-pound, 10-pound, 15-pound, 20-pound, 25-pound, etc. dumbbells). Some specialized light-weight dumbbell sets are also available in 1-pound weight increments (e.g., 1-pound, 2-pound, 3-pound, 4-pound, and 5-pound). Generally, weight increments for plates for adjustable weight bars are more limited (e.g., 5-pound, 10-pound, 25-pound, 35-pound, and 45-pound). While such weight increments are suitable for some individuals and/or some exercises, they do not allow for slight weight adjustments. Relatively small weight increments, e.g., of less than 5 pounds, or less than 2.5 pounds, or less than 1 pound, would be beneficial for individuals seeking or requiring more gradual adjustments to weight devices.

Various devices that allow for smaller weight adjustments have been developed. For example, one design provides for a 2.5-pound add-on weight suitable for use with a conventional loading sleeve of a barbell. The barbell add-on weight includes a fixed diameter opening configured to receive the weight loading sleeve of a barbell. While such add-on weights provide additional flexibility in weight adjustment, they do not allow for slight weight adjustments (e.g., less than 2.5 pounds). Moreover, such add-on weights are not suitable for use with most fixed weight dumbbells or barbells.

Other designs provide for specialized devices or systems that allow for weight adjustment. For example, U.S. Pat. No. 4,913,422 discloses a barbell including a handle and sleeves at opposing ends thereof. Hollow Tillable add-on weights are received on the sleeves, and may be filled with water, sand, etc. in order to increase the overall weight. U.S. Pat. No. 6,083,144 discloses a dumbbell system including a handle and a plurality of weight plates selectively attached to the handle via an arrangement of holes and slots that cooperate with a connecting pin. Similarly, U.S. Pat. No. 7,794,373 discloses a dumbbell system including a handle and a series of plates selectively securable thereto via a collar, selector knob and locking mechanism. Such devices are relatively complicated, stand-alone devices that are not usable with conventional barbells or dumbbells. Moreover, they generally fail to provide for relatively low weight adjustment.

U.S. Pat. No. 4,743,017 discloses a conventional dumbbell having a central bar and weights on opposing ends thereof, and an add-on weight member that attaches to the dumbbell via a pair of clips. The add-on weight member includes a U-shaped member including a central portion spaced from the bar of the dumbbell and legs extending from opposing ends, which clip onto the bar adjacent to the weights. Thus, the add-on weight member of the '017 patent is specifically configured for use with a particularly sized dumbbell. Moreover, the configuration of the U-shaped member is awkward for many exercises.

U.S. Pat. No. 10,252,098 discloses a weight adjustment device having a disc-shaped body and a central aperture therethrough. The aperture has a diameter corresponding to the specific diameter of a weight bar. The body is formed from an elastic or flexible material to allow the body to be twisted or deformed in order to fit around the bar. After twisting the device onto the bar, the elastic body returns to its original shape. Although the device of the '098 patent provides some benefits over prior designs, it is only suitable for use with bars having a diameter corresponding to the diameter of the central aperture given the aperture diameter is not variable. Such device therefore cannot be used with a bar having a diameter larger than the aperture diameter. Moreover, the device of the '098 patent tends to slide along the bar and/or rotate around the bar during use. Further, the elastic body is prone to wear and/or damage due to repeated twisting and deformation required for installation and de-installation of the device on the bar.

Accordingly, there is a need for a device suitable for use with weightlifting equipment, e.g., such as dumbbells, barbells and kettlebells, that solves some or all of the problems and disadvantages associated with prior designs.

SUMMARY OF THE INVENTION

The present invention is directed to a weight modification clamp suitable for use with a weight-lifting device, e.g., a dumbbell, a barbell, a kettlebell, etc. The weight modification clamp includes first and second hingedly connected plates. The first plate has opposing first and second sides, a first end portion, and an opposite second end portion. The second plate has opposing first and second sides, a first end portion, and an opposite second end portion. The first end portions of the plates are pivotably connected and movable about a rotational axis, so that the second end portions of the first and second plates are movable between an open orientation and a closed orientation and along a plane substantially perpendicular to the rotational axis. In addition, the first and second plates define a central opening intermediate the first and second end portions thereof. The central opening has a first diameter when the first and second plates are in the closed orientation and a second diameter when the first and second plates are in the open orientation, wherein the first diameter is less than the second diameter. The central opening is configured to receive a bar or handle portion of a dumbbell, a barbell, a kettlebell, or other such device.

In some embodiments, the weight modification clamp includes a tensioning member coupled to the first and second plates and configured to tension the first and second plates toward the closed orientation. In some implementations, the tensioning member is a spring (e.g., a torsion spring) coupled to the first end portions of the plates.

In some embodiments, the second end portions of the first and second plates define an indent including indent walls extending from distal portions thereof toward the central opening. In some implementations, the indent walls are angularly disposed and/or splay outwardly from the central opening toward the distal portions thereof. In some implementations, the distal portions of the indent walls define a peripheral opening of the indent, wherein the peripheral opening has a first length and the bar has a diameter having a second length equal to or less than the first length. In some implementations, the second end portions of the first and second plates are maintained in a partially open orientation when the bar is disposed in the central opening. Preferably, inner surfaces defining the central opening are tensioned against the bar when disposed therein.

In some embodiments, each of the first and second plates comprises an outer edge having a generally arcuate configuration, so that the weight modification clamp has a generally circular configuration in plan view. In some embodiments, the first side of each of the first and second plates comprises a stepped configuration having a first step portion proximate to the first end portion and a second step portion extending outwardly from the first step portion. In some implementations, the first step portion comprises a recess configured for receiving a tensioning member, which is configured to tension the first and second plates toward the closed orientation. In some embodiments, the first and second plates have an identical configuration.

In some embodiments, the weight modification clamp has a weight of between about 0.5 pound and about 3.0 pounds. For example, the weight modification clamp may have a weight of 0.5 pound, or 0.75 pound, or 1.0 pound, or 1.25 pounds, or 1.5 pounds, or 1.75 pounds, or 2.0 pounds, or 2.5 pounds, or 3.0 pounds. Preferably, the first and second plates are formed of metal, or other durable and rigid material.

In some embodiments, the second end portions of the first and second plates of the weight modification clamp subtend an angle of at least about 45° between the open and closed orientations. Preferably, the second end portions of the first and second plates subtend an angle of between about 75° and about 100° between the open and closed orientations, e.g., 80°, or 85°, or 90°, or 95° between the open and closed orientations.

In some embodiments, at least one of the first and second sides of said first plate and/or said second plate comprises a cutout portion(s) extending though opposing sides thereof, thereby reducing the total weight of the weight modification clamp as compared to the clamp if lacking such cutout portion(s). In some embodiments, at least one of the first and second sides of the first plate and/or second plate comprises a raised portion(s), thereby increasing the total weight of the weight modification clamp as compared to the clamp if lacking such raised portion(s).

The present invention also relates to a method of adding additional weight to a weight-lifting device, comprising the steps of: providing a weight adjustment clamp, the weight adjustment clamp comprising first and second plates having first end portions hingedly connected together and opposite second end portions, the weight adjustment clamp defining a central opening configured to receive a bar; pivoting the second end portions of the weight adjustment clamp from a closed orientation to an open orientation to define an indent in communication with the central opening; moving a portion of a bar of the weight-lifting device through the indent and into the central opening; and pivoting the second end portions of the weight adjustment clamp from the open orientation toward the closed orientation until inner surfaces of the first and second plates defining the central opening engage the portion of the bar. In some implementations, the inner surfaces defining the central opening tensionably engage the portion of the bar when it is disposed in the central opening.

DETAILED DESCRIPTION OF EMBODIMENTS OF THE INVENTION

Figure 2:
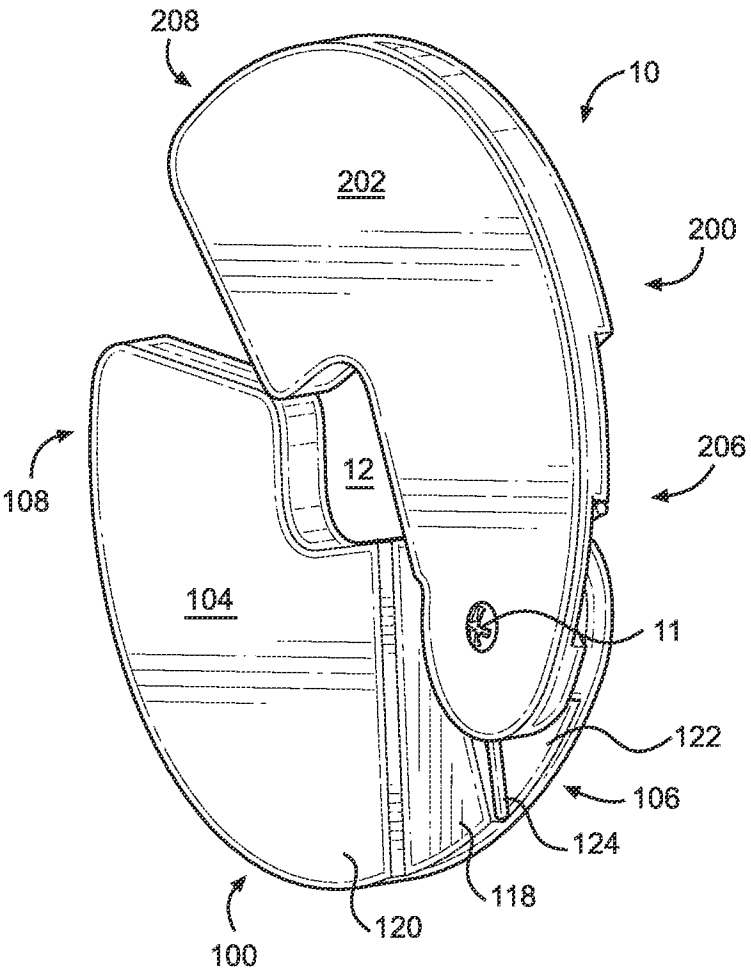
FIG. 2 is a rear perspective view of the weight modification clamp according to a disclosed embodiment and showing the clamp in the closed orientation.

The terms "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation. In addition, identical components or portions of the various embodiments are identified with identical reference numerals.

Figure 1:
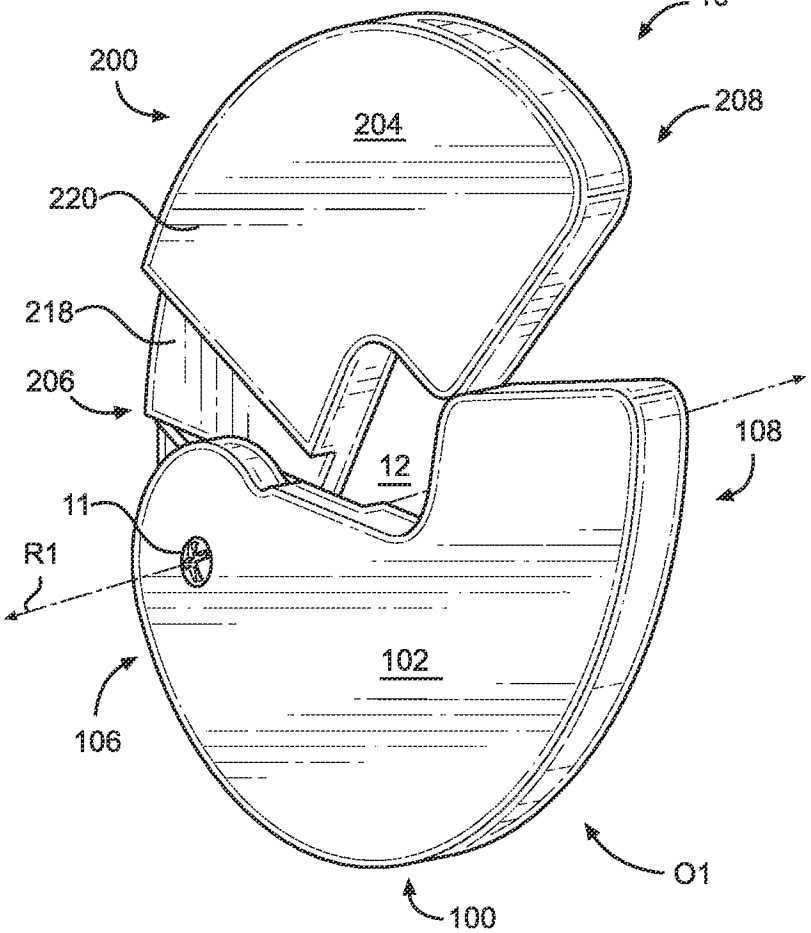
FIG. 1 is a front perspective view of a weight modification clamp according to an embodiment of the present invention and showing the clamp in a closed orientation.
Figure 4:
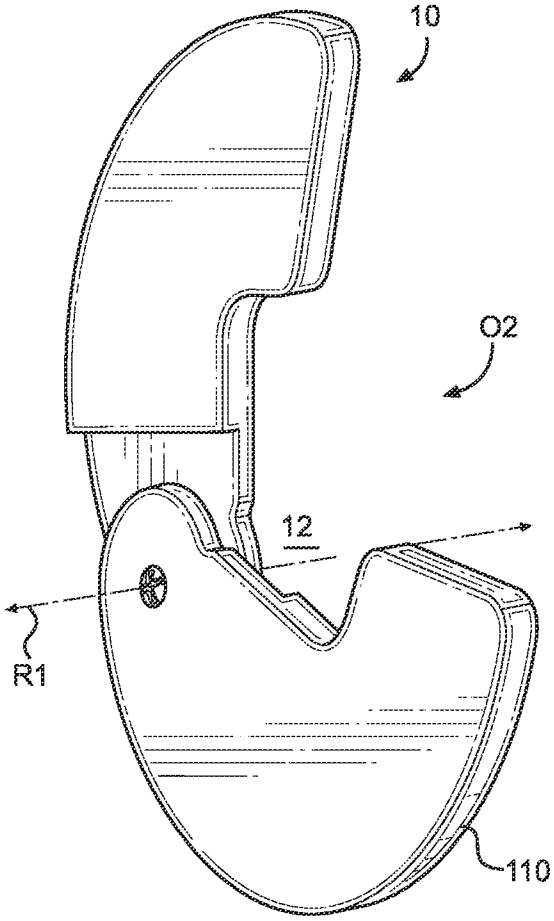
FIG. 4 is a front perspective view of the weight modification clamp according to a disclosed embodiment and showing the clamp in an open orientation.
Figure 3:
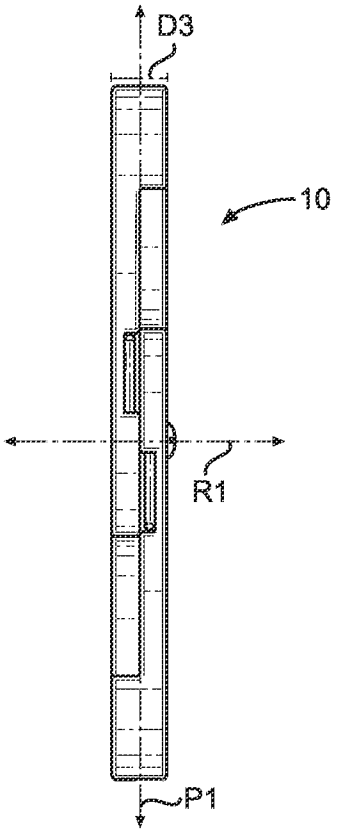
FIG. 3 is a rear view of the weight modification clamp according to a disclosed embodiment.

Referring to FIGS. 1 and 2, a weight modification clamp 10 according to an embodiment of the present invention includes a first plate 100 hingedly connected to a second plate 200. The first plate 100 includes opposing first and second sides 102, 104, a first end portion 106, and an opposite second end portion 108. Similarly, the second plate 200 includes opposing first and second sides 202, 204, a first end portion 206, and an opposite second end portion 208. The first end portions 106, 206 of the first and second plates 100, 200 are pivotably connected via a fastener 11 (e.g., a rivet, bolt, screw, pin or the like) so that the second end portions 108, 208 of the first and second plates 100, 200 are movable about a rotational axis R1. The first and second plates 100, 200 are movable between a closed orientation O1 as shown in FIGS. 1-3, and an open orientation O2 as shown in FIG. 4. In addition, the first and second end portions 108, 208 of the first and second plates 100, 200 are movable between the closed and open orientations O1, O2 and along a plane P1 substantially perpendicular to the rotational axis R1, as shown in FIG. 3.

Figure 6:
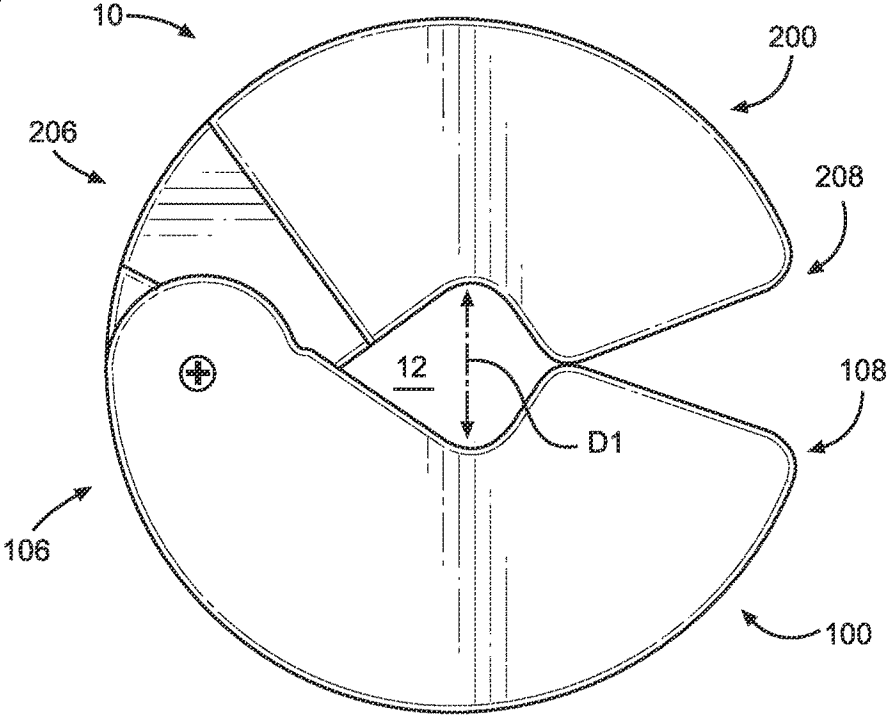
FIG. 6 is a plan side view of the weight modification clamp according to a disclosed embodiment and showing the clamp in a closed orientation.
Figure 7:
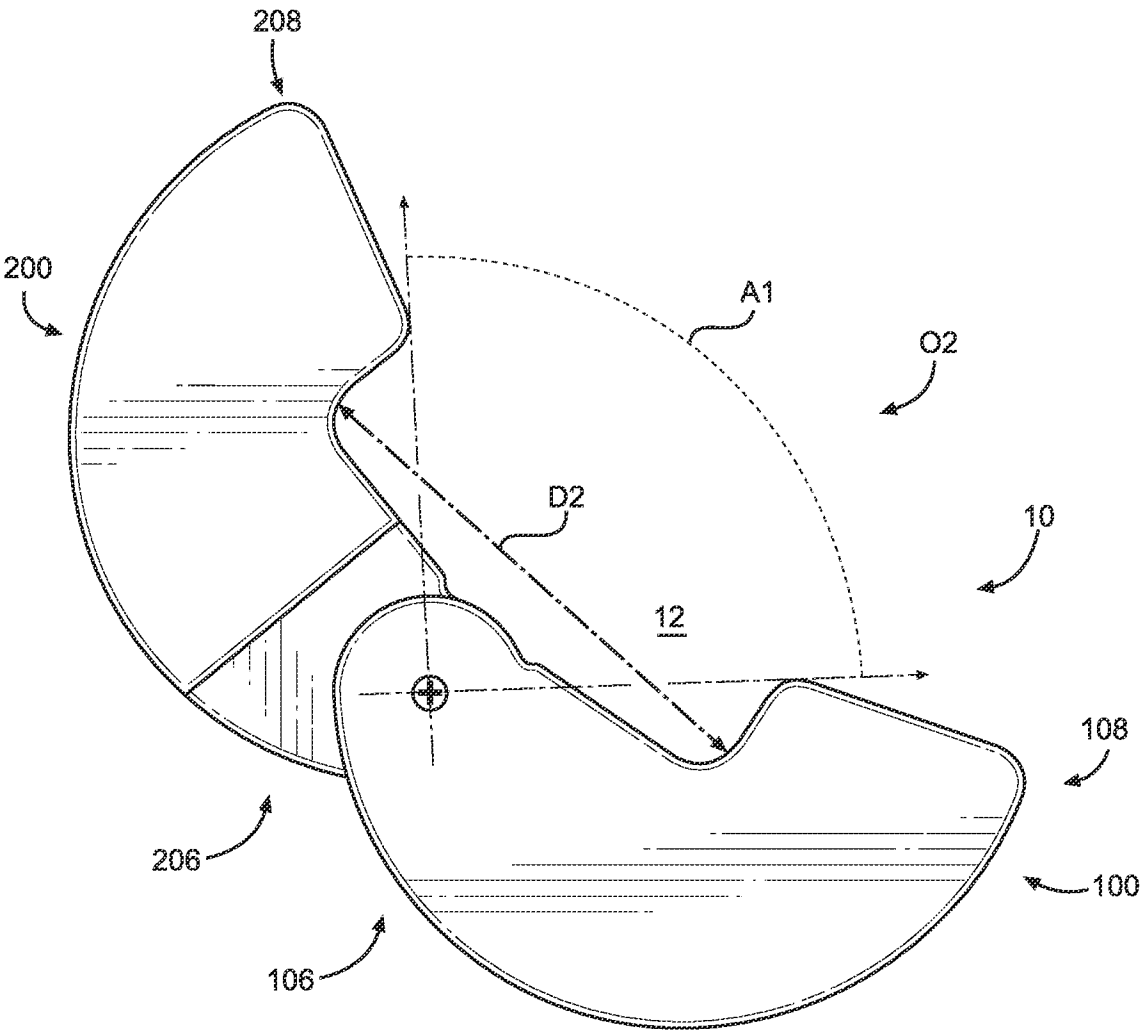
FIG. 7 is a plan side view of the weight modification clamp according to a disclosed embodiment and showing the clamp in an open orientation.
Figure 8:
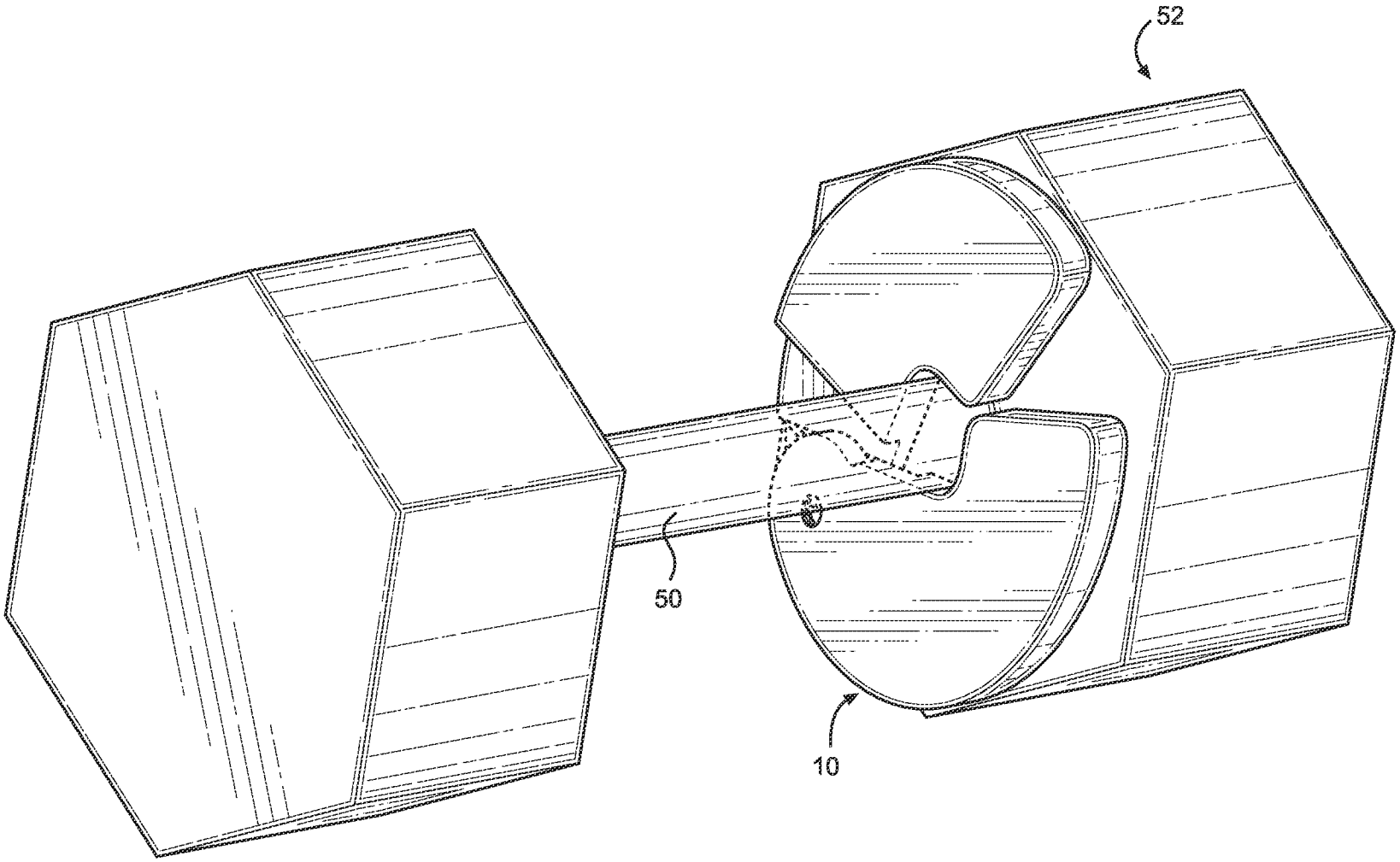
FIG. 8 is a perspective view of the weight modification clamp according to a disclosed embodiment and showing the clamp removably secured to a bar or handle portion of a dumbbell.

Referring to FIGS. 6-7, the first and second plates 100, 200 define a central opening 12 intermediate the first end portions 106, 206 and the second end portions 108, 208 thereof. The central opening 12 has a first diameter D1 when the first and second plates 100, 200 are in the closed orientation O1 and a second diameter D2 when the first and second plates 100, 200 are in the open orientation O2. The first diameter D1 is less than the second diameter D2. The central opening 12 is configured to receive a handle portion or bar 50 of a weightlifting device 52, e.g., a bar of a dumbbell, a barbell, a kettlebell, etc., as shown in FIG. 8.

Referring again to FIGS. 4-6, the first plate 100 includes an outer wall 110, and the second plate 200 includes an outer wall 210. In some embodiments, the outer walls 110, 210 of the first and second plates 100, 200 have a generally accurate configuration in plan view, so that the weight modification clamp 10 has a generally circular configuration in plan view when disposed in the closed orientation O1, as shown in FIG. 6. In some embodiments, the first and second plates 100, 200 have identical configurations, thereby minimizing complexity and thus manufacturing costs thereof.

Preferably, the weight modification clamp 10 is relatively thin (see, e.g., FIGS. 3 and 8), so that it requires only a minimal amount of space on the bar 50. Thus, the weight modification clamp 10 allows for much more space on the bar 50 for a user's hand as compared to prior devices (e.g., such as the elastomeric device disclosed in U.S. Pat. No. 10,252,098). For example, the overall caliper or thickness (identified as D3 in FIG. 3) of the weight modification clamp 10 is preferably less than about 1.0 inch, e.g., between about 0.2 inch and about 0.8 inch, and more preferably between about 0.3 inch and about 0.6 inch. In one implementation, the overall caliper D3 of the weight modification clamp 10 is about 0.4 inch.

Preferably, the first and second plates 100, 200 are metal. For example, the first and second plates 100, 200 may be fabricated from pressed metal (e.g., pressed steel). Metal pressing fabrication techniques are extremely accurate and allow for the manufacture of the plates 100, 200 (and thus the primary components of the weight modification clamp 10) to precise specifications. For example, metal pressing allows for the manufacture of a metal part having a target weight, with accuracy within +/−5 grams of such target weight. However, one of skill in the art would readily appreciate that the first and second plates 100, 200 may be fabricated utilizing other processes (e.g., machining, punching, casting, etc.). In addition, the first and second plates 100, 200 may be fabricated from other rigid and durable materials (e.g., durable rubber, plastic, stainless steel, etc). In addition, the first and second plates 100, 200 may include a coating (e.g., paint, rubber, fluorocarbon or fluoropolymer-based material, e.g., XYLAN®, anti-rust, etc.) using processes well known in the art (e.g., e-coating, powder coating, surface finishing, etc). The first and second plates 100, 200 are extremely durable and designed to last at least the lifetime of the user. In contrast, prior designs utilizing rubber or plastic structural components are prone to wear and tear, dry rot and/or brittleness with use, particularly prior designs that include rubber or plastic joints that are repeatedly deformed or twisted during use.

The weight modification clamp 10 preferably has a total weight (i.e., the overall combined weight of all component parts thereof) of between about 0.5 pound and about 3.0 pounds. In some implementations, the weight modification clamp 10 has a total weight of about 0.5 pound, or about 0.75 pound, or about 1.0 pound, or about 1.25 pounds, or about 1.5 pounds, or about 1.75 pounds, or about 2.0 pounds, or about 2.5 pounds, or about 3.0 pounds. In some embodiments, a plurality of weight modification clamps 10 having various weights are provided as a clamp set, e.g., including 0.50 pound, 0.75 pound, 1.0 pound, 1.25 pound, 1.5 pound, and 2.5 pound variants of the weight modification clamp 10. Thus, the weight modification clamp 10 may be manufactured to have a specific desired weight and within a narrow tolerance of precision via the manufacturing process utilized.

Figure 9:
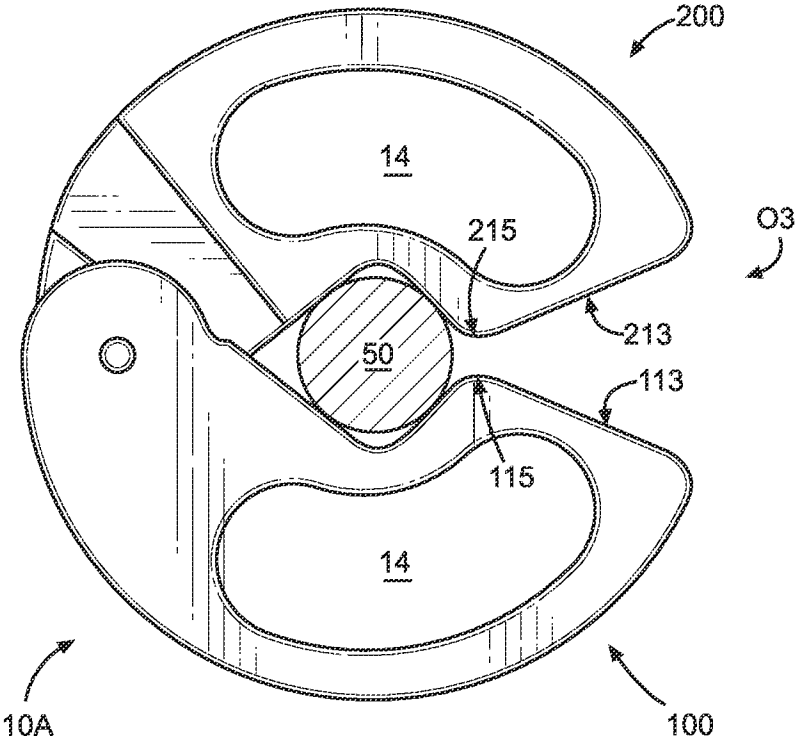
FIG. 9 is a plan side view of a weight modification clamp according to a disclosed embodiment and showing the clamp in a partially open orientation and removably secured to a bar.

In order to provide for different overall weights of the variants, the thickness and/or dimensions of the weight modification clamp 10 may be altered (e.g., providing for larger and/or thicker first and second plates 100, 200, and thus a larger and heavier weight modification clamp 10) in order to increase the desired target weight of the weight modification clamp 10 as compared to a smaller dimensioned weight modification clamp 10. Alternatively or in addition, the first and/or second plates 100, 200 may include one or more cutout region(s) 14 extending through the first and/or second plates 100, 200, as shown in FIG. 9, such that less metal is required to form the first and/or second plates 100, 200 as compared to a similarly dimensioned plate that lacks such cutout region(s) 14. In this way, the total weight of a weight modification clamp 10A may be reduced (as compared to the weight modification clamp 10 if lacking such cutout regions). Conversely, the first and/or second plates 100, 200 may include one or more raised region(s), such that that more metal is required to form the first and/or second plates 100, 200 as compared to a similarly dimensioned plate that lacks such raised region(s), thereby increasing the overall weight of a weight modification clamp (as compared to the weight modification clamp 10 if lacking such raised regions). Alternatively or in addition, additional weighted portions maybe secured to the first and/or second plates 100, 200 (e.g., such as magnetic weighted portions that magnetically attached to the plates 100, 200) in order to increase the overall weight of the first and/or second plates 100, 200.

Referring again to FIG. 5, the weight modification clamp 10 includes a tensioning member 18 coupled to the first and second plates 100, 200, which is configured to tension the first and second plates 100, 200 toward the closed orientation O1. In some embodiments, the tensioning member 18 is a spring, e.g., a torsion spring. In one implementation, the tensioning member 18 is coupled to the first end portions 106, 206 of the first and second plates 100, 200.

The tensioning member 18 (e.g., torsion spring) ensures that the first and second plates 100, 200 are biased toward the closed orientation O1, thereby tensioning the first and second plates 100, 200 against the bar 50. In this way, the first and second plates 100, 200 are releasably retained against and around the bar 50, thereby securely maintaining the weight modification clamp 10 around the bar 50. Further, the tensioning force prevents or substantially reduces the possibility that the weight modification clamp 10 will move when attached to the bar 50. Thus, the weight modification clamp may be readily maintained in a desired position on the bar 50 (see FIG. 8), and any movement thereon (e.g., sliding along the longitudinal axis of the bar and/or spinning or rotating around the bar) is prevented or substantially reduced.

Figure 11:
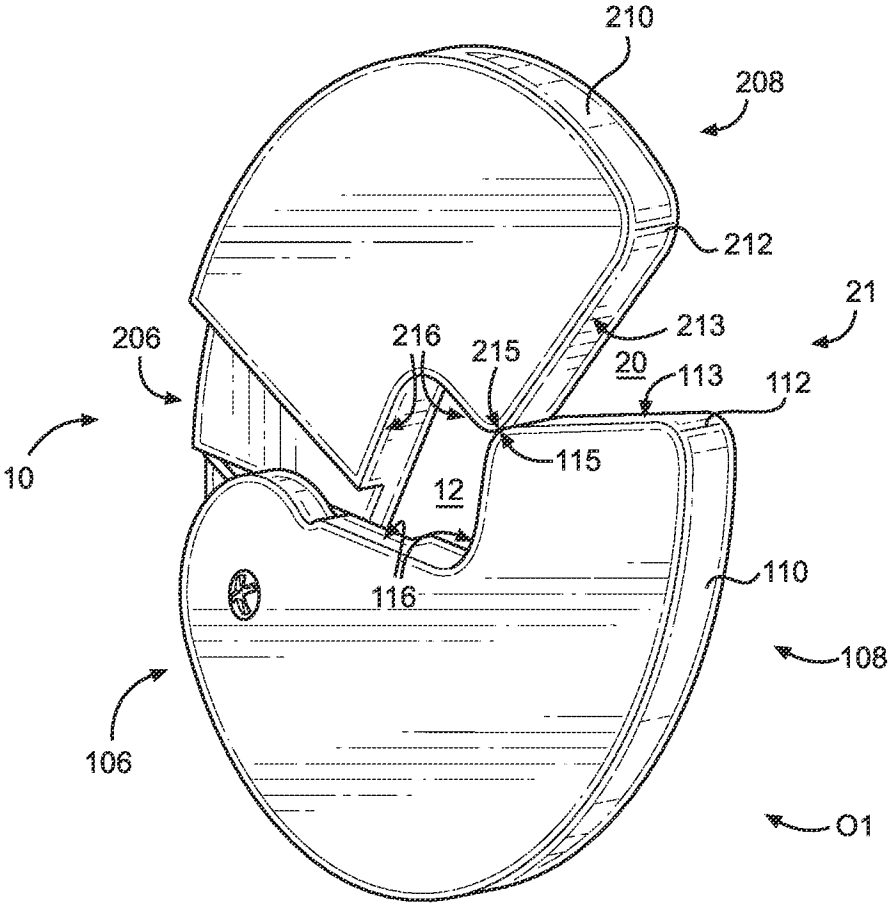
FIG. 11 is another front perspective view of the weight modification clamp according to a disclosed embodiment and showing the clamp in a closed orientation.

Referring to FIG. 11, the second end portions 108, 208 of the first and second plates 100, 200 preferably define an indent 20 extending inwardly from distal portions 112, 212 adjacent the outer walls 110, 210 thereof, respectively, and toward the central opening 12. In one implementation, the first plate 100 includes an indent wall 113 that extends from the distal portion 112 to a protrusion 115 adjacent to the central opening 12. Similarly, the second plate 200 includes an indent wall 213 that extends from the distal portion 212 to a protrusion 215 adjacent to the central opening 12. The indent walls 113, 213 of the first and second plates 100, 200 splay outwardly from the protrusions 115, 215 toward the distal portions 112, 212. The distal portions 112, 212 define an opening or gap 21 in the periphery of the weight modification clamp 10, through which the bar 50 is received.

Preferably, when the weight modification clamp 10 is disposed in its closed orientation O1, the length or distance between the distal portions 112, 212 of the first and second plates 100, 200 is at least equal to, and preferably slightly larger than, the diameter of the bar 50. In this way, the bar 50 is readily received through the gap 21 and into the indent 20. As the bar 50 is moved into and through the indent 20 and toward the central opening 12, the bar 50 engages the indent walls 113, 213 of the first and second plates 100, 200, thereby pushing the second end portions 108, 208 apart due to the splayed or angular configuration of the indent walls 113, 213 and the pivotal connection of the first end portions 106, 206 thereof. Thus, the weight modification clamp 10 is thereby moved or reconfigured from its closed orientation O1 toward its open orientation O2. The second end portions 108, 208 of the first and second plates 100, 200 continue to move outwardly along the plane P1 and away from each other, until the bar 50 moves past the protrusions 115, 215 and into the central opening 12, as shown in FIGS. 8-10.

Figure 10:
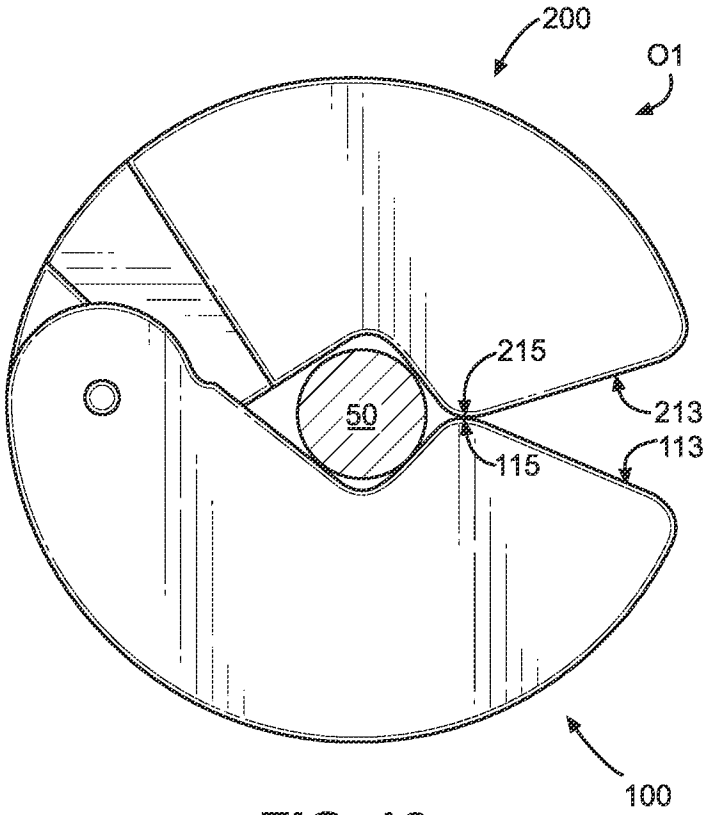
FIG. 10 is a plan side view of a weight modification clamp according to a disclosed embodiment and showing the clamp in a closed orientation and removably secured to a bar.

With reference to FIGS. 9-11, after the bar 50 has been moved or pushed into the central opening 12, the weight modification clamp 10 then moves from its open orientation O2 back toward its closed orientation O1 due to the tensioning member 18. In this way, inner surfaces 116, 216 of the first and second plates 100, 200 and defining the central opening 12 are tensioned against the bar 50. Depending on the diameter of the bar 50, the first and second plates 100, 200 may continue to move into the fully closed orientation O1 via the tensioning member 18 when the bar 50 is disposed within the central opening 12, such that the protrusions 115, 215 engage or contact each other, as shown in FIG. 10. More preferably, if the bar 50 has a diameter greater than the diameter D1 of the central opening 12 when the weight modification clamp 10 is in its fully closed orientation O1, the first and second plates 100, 200 are retained in a partially open orientation O3 when such larger diameter bar 50 is disposed in the central opening 12, such that the protrusions 115, 215 are spaced from each other as shown in FIGS. 8 and 9. Note that even when disposed in such partially open orientation O3, the inner surfaces 116, 216 of the first and second plates 100, 200 are tensioned against the bar 50, thereby restricting or substantially reducing any movement of the weight modification clamp 10 relative to the bar 50.

Preferably, the overall size and configuration of the weight modification clamp 10 is capable of receiving and tensionably retaining in the central opening 12 thereof a bar 50 having a dimeter of between about 1.0 inch and about 2.0 inch. For example, the weight modification clamp 10 is suitable for use on a bar 50 having a diameter of between about 1.2 inch and about 1.5 inch, which are common diameters for the bar or handle of conventional dumbbells, barbells, and kettlebells. Preferably, when the weight modification clamp 10 is disclosed in the closed orientation O1, the first diameter D1 of the central opening 12 is slightly less than the diameter of the bar 50 (e.g., the first diameter D1 may be about 1.0 inch, while a conventional bar 50 has a diameter of about 1.2 inch), so that the weight modification clamp 10 is disposed in the partially opening orientation O3 with inner surfaces 116, 216 engaging the bar 50 when clamped thereon. Further, the weight modification clamp 10 may also be pivoted into an open orientation O2 (see FIG. 4) capable of receiving in the central opening 12 thereof a bar 50 having a larger diameter, e.g., such as a diameter of about 2.0 inch, which is a common diameter for the weight loading sleeve of a barbell.

Referring again to FIGS. 6 and 7, the second end portions 108, 208 of the first and second plates 100, 200 are movable from the closed orientation O1 to the open orientation O2, and subtend an angle (A1) of at least about 45° therebetween. More preferably, the second end portions 108, 208 of the first and second plates 100, 200 subtend an angle A1 of between about 75° and about 100° between the open and closed orientations O1, O2. For example, in one implementation the second end portions 108, 208 of the first and second plates 100, 200 subtend an angle of about 80°, or about 90°, or about 95°, or about 100° (as shown in FIG. 7). However, it should be understood that the specific range of pivotal motion of the second end portions 108, 208 of the first and second plates 100, 200 may be adjusted by altering the configuration of the first end portions 106, 206 of the first and second plates 100, 200 and/or by altering the configuration and/or tensioning capability of the tensioning member 18.

Figure 5:
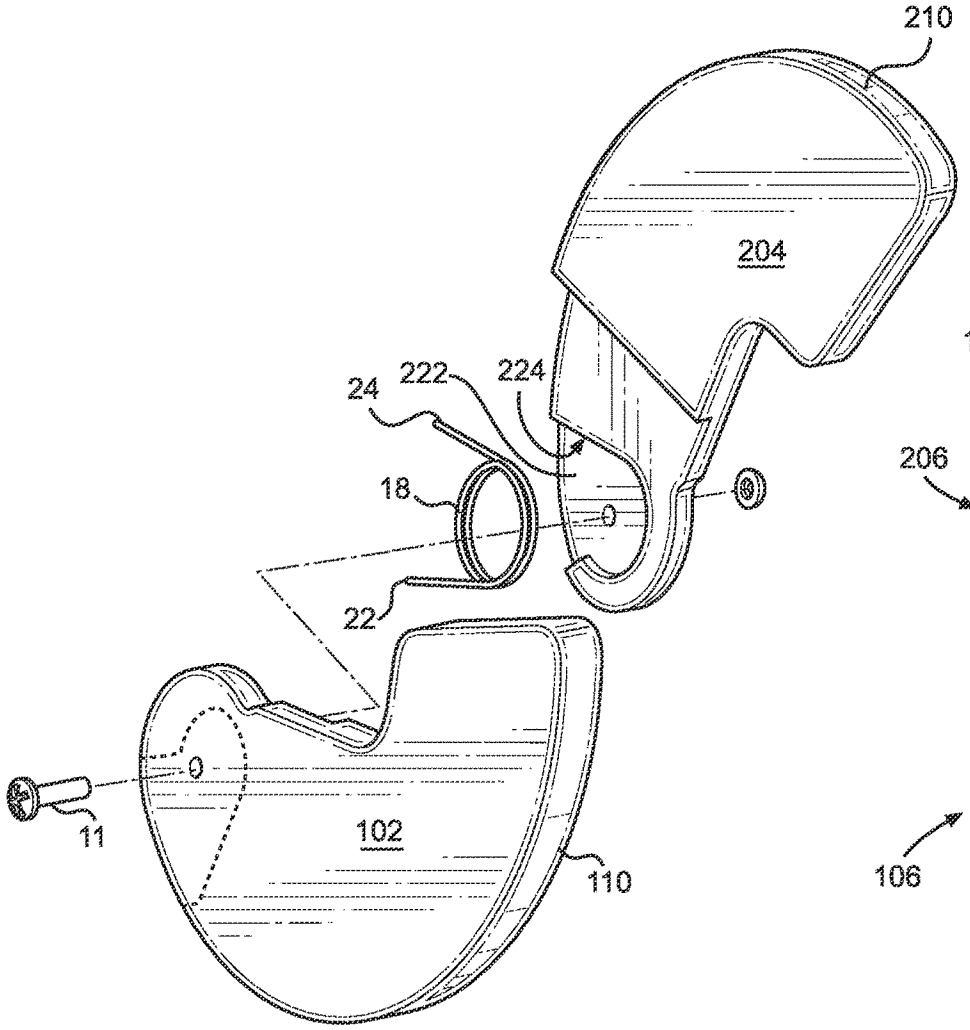
FIG. 5 is an exploded perspective view of components of the weight modification clamp according to a disclosed embodiment.

Referring again to FIGS. 1, 2 and 5, the second side 104 of the first plate 100 preferably comprises a stepped configuration. First end portion 106 of the first plate 100 includes or defines a first step region 118. A second step region 120 extends outwardly from the first step region 118. Similarly, the second side 204 of the second plate 200 preferably comprises a stepped configuration. First end portion 206 of the second plate 100 includes or defines a first step region 218. A second step region 220 extends outwardly from the first step region 218. In some implementations, the first step regions 118, 218 of the first and second plates 100, 200 each include a recess 122, 222, respectively, which together are configured for receiving the tensioning member 18, as best shown in FIG. 5. A portion or end 22 of the tensioning member 18 engages a sidewall 124 of the recess 122 of the first plate 100, and another portion or opposing end 24 of the tensioning member 18 engages a sidewall 224 of the recess 222 of the second plate 200. In this way, spinning or undesired movement of the tensioning member 18 is restricted. In some embodiments, the rotational axis R1 of the first and second plates 100, 200 extends through the recesses 118, 218. The tensioning member 18 (e.g., a torsion spring) may be disposed around the fastener 11 and axially aligned with the rotational axis R1, as shown in FIGS. 4 and 5.

While the invention has been described in connection with exemplary embodiments thereof, it will be understood that it is capable of further modifications. In addition, features of one embodiment may be utilized in another embodiment. Thus, this application is intended to cover any variations, uses, or adaptations of the invention following the principles of the invention and including such departures from the present disclosure as come within known practice within the art to which the invention pertains and as may be applied to the features hereinbefore set forth.

What is claimed is:

1. A weight modification clamp comprising:

a first plate having opposing first and second sides, a first end portion, and an opposite second end portion;

a second plate having opposing first and second sides, a first end portion, and an opposite second end portion, wherein said first side of each of said first and second plates comprises a stepped configuration having a first step portion proximate to said first end portion and a second step portion extending outwardly from said first step portion;

wherein said first end portions of said first and second plates are pivotably connected and movable about a rotational axis, so that said second end portions of said first and second plates are movable between an open orientation and a closed orientation and along a plane substantially perpendicular to said rotational axis;

a tensioning member coupled to said first and second plates and configured to tension said first and second plates toward said closed orientation; and wherein said first and second plates define a central opening intermediate said first and second end portions thereof, said central opening having a first diameter when said first and second plates are in said closed orientation and a second diameter when said first and second plates are in said open orientation, said first diameter less than said second diameter, and said central opening configured to receive a bar of a weight-lifting device; and wherein said second end portions of said first and second plates define an indent including indent walls extending from distal portions thereof toward said central opening.

2. The weight modification clamp of claim 1, wherein said indent walls splay outwardly from said central opening toward said distal portions.

3. The weight modification clamp of claim 2, wherein said distal portions of said indent walls define a peripheral opening of said indent, said peripheral opening having a first length, and said bar having a diameter having a second length equal to or less than said first length.

4. The weight modification clamp of claim 1, wherein said second end portions of said first and second plates are maintained in a partially open orientation when said bar is disposed in said central opening, and wherein inner surfaces of said first and second plates defining said central opening are tensioned against said bar when said bar is disposed in said central opening.

5. The weight modification clamp of claim 4, wherein said inner surfaces of said first and second plates are tensioned against said bar via said tensioning member when said bar is disposed in said central opening and said second end portions of said first and second plates are maintained in said partially open orientation.

6. The weight modification clamp of claim 1, which has a weight of between about 0.5 pound and about 3.0 pounds.

7. The weight modification clamp of claim 6, which has a weight selected from the group consisting of 0.5 pound, 0.75 pound, 1.0 pound, 1.25 pounds, 1.5 pounds, 1.75 pounds, 2.0 pounds, 2.5 pounds, and 3.0 pounds.

8. The weight modification clamp of claim 1, wherein said second end portions of said first and second plates subtend an angle of at least about 45° between said open and closed orientations.

9. The weight modification clamp of claim 8, wherein said second end portions of said first and second plates subtend an angle of between about 75° and about 100° between said open and closed orientations.

10. The weight modification clamp of claim 1, wherein said tensioning member is a spring coupled to said first end portions of said first and second plates.

11. The weight modification clamp of claim 1, wherein each of said first and second plates comprises an outer wall having a generally arcuate configuration, so that the weight modification clamp has a generally circular configuration in plan view when disposed in said closed orientation.

12. The weight modification clamp of claim 1, wherein each of said first step portions comprises a recess, said recesses configured for receiving said tensioning member configured to tension said first and second plates toward said closed orientation.

13. The weight modification clamp of claim 1, wherein said first and second plates have identical configurations.

14. The weight modification clamp of claim 1, wherein at least one of said first and second sides of said first plate and/or said second plate comprises a cutout portion.

15. The weight modification clamp of claim 1, wherein said first and second plates are formed from metal.

16. The weight modification clamp of claim 1, wherein:

said first side of said first plate and said second step portion of said second side of said second plate are coplanar; and said first side of said second plate and said second step portion of said second side of said first plate are coplanar.

* * * * *